US006648671B2

(12) United States Patent
Suzuki et al.

(10) Patent No.: US 6,648,671 B2
(45) Date of Patent: Nov. 18, 2003

(54) JOINT CONNECTOR

(75) Inventors: Kaoru Suzuki, Shizuoka (JP); Nobuhiro Takada, Aichi (JP); Koji Toda, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/230,317

(22) Filed: Aug. 29, 2002

(65) Prior Publication Data

US 2003/0045158 A1 Mar. 6, 2003

(30) Foreign Application Priority Data

Aug. 30, 2001 (JP) ..... P2001-261385

(51) Int. Cl.[7] ..... H01R 4/24
(52) U.S. Cl. ..... 439/404
(58) Field of Search ..... 439/402, 404, 439/405, 408, 395

(56) References Cited

U.S. PATENT DOCUMENTS 5,199,899 A * 4/1993 Ittah ..... 439/403
6,299,472 B1 * 10/2001 Beukes ..... 439/403
6,457,989 B1 * 10/2002 Aoki et al. ..... 439/402
6,551,129 B2 * 4/2003 Kato ..... 439/497

FOREIGN PATENT DOCUMENTS

| | | |
|---|---|---|
| JP | 63-106067 | 7/1988 |
| JP | 63-112769 | 7/1988 |
| JP | 6-44034 | 6/1994 |
| JP | 7-263036 | 10/1995 |

* cited by examiner

*Primary Examiner*—Tulsidas Patel
(74) *Attorney, Agent, or Firm*—Sughrue Mion, PLLC

(57) ABSTRACT

A connector includes first wire-holding portions (3) for holding power-supplying wires (2) in a juxtaposed manner, a second wire-holding portion (6) for alternately holding earth wires (4) and signal-purpose or power-receiving wires (5) for auxiliary equipments in a juxtaposed manner in a direction substantially perpendicular to a longitudinal direction of the wires (2) held by the first wire holding portions (3), a plurality of press-contacting joint terminals (8), each including a second press-contacting terminal (18) for connection to the corresponding signal-purpose or power-receiving wire (5) and a first press-contacting terminal (17) which is connected to the second press-contacting terminal (18), and can be connected to the corresponding wire (2) held by the first wire-holding portions (3), and an earth terminal (9) which can be connected to the earth wires (4) and can be connected to an earth side.

7 Claims, 4 Drawing Sheets

20
18
28
27
19
8
8c
9
20
17
19
16
21
24
28
22
26
25
27
23
6
10
6a
12
3a
15
14
7
13
15
11
14
3
3b

JOINT CONNECTOR

BACKGROUND OF THE INVENTION

This invention relates to a joint connector in which the processing of wires of earth circuits and the processing of wires of power circuits can both be effected.

For effecting the grounding (earthing) processing for auxiliary equipments in a vehicle, electrical equipments or the like, there has been used an earth connector by which wires of a plurality of earth circuits are connected in a collected manner to the earth side.

Various earth connectors are known, and one of such connectors is disclosed in JP-A-6-44034U.

As shown in FIG. 4, this earth connector comprises an earth terminal 33, which has an earth connection portion 31 (for connection to the earth side) formed at a substantially central portion of one longer side of a rectangular plate-like base portion 30 and also has a plurality of juxtaposed wire press-contacting portions 32 formed at the other longer side of the base portion, and a connector housing 37 which includes wire holding portions 35 for respectively holding wires 34 of earth circuits and insertion grooves 36 formed in the wire holding portions 35 so as to receive the wire press-contacting portions 32 of the earth terminal 33. The wires 34 of the earth circuits are held in the wire holding portions 35, respectively, and the wire press-contacting portions 32 of the earth terminal 33 are inserted into the insertion grooves 36, thereby electrically connecting the wires 34 to the earth terminal 33.

As described above, in the earth connector, the wires of the earth circuits are held in the wire holding portions of the connector housing, and the wire press-contacting portions of the earth terminal are inserted into the insertion grooves, and are connected in a press-contacted manner to the wires, respectively. Therefore, the grounding operation can be effected easily, and the production cost can be reduced since any special apparatus is not necessary. However, this earth connector is designed to effect only the grounding processing, and therefore at an intermediate joint, a separate power connector for processing wires of power circuits is required in addition to the earth connector. Namely, the wire of the power circuit and the wire of the earth circuit in one auxiliary equipment must be connected to the separate connectors, respectively, and it is difficult to arrange the wires in a collected manner, and the efficiency of the operation is low.

SUMMARY OF THE INVENTION

Therefore, this invention has been made under the above circumstances, and an object of the invention is to provide a joint connector in which the processing of wires of earth circuits and the processing of wires of power circuits can both be effected.

1. A joint connector comprising:

a first wire-holding portion for holding first wires in a juxtaposed manner;

a second wire-holding portion for alternately holding earth wires and second wires for an auxiliary equipment in a juxtaposed manner in a direction substantially perpendicular to a longitudinal direction of the first wires;

a plurality of press-contacting joint terminals, each including, a first press-contacting terminal to be electrically connected to the first wires, and a second press-contacting terminal to be electrically connected to the second wires, which connected to the first press-contacting terminal; and an earth terminal for earthing to be electrically connected to the earth wires.

(2) The joint connector according to (1), wherein the earth wires and the second wires are held by the second wire-holding portion so that one ends of the earth wires and the second wires are disposed to a side of the first wires, each of the plurality of press-contacting joint terminals includes a terminal base portion extending in a longitudinal direction of the second terminals, the second press-contacting terminal is formed at one end of the terminal base portion, the first press-contacting terminal is formed at a portion of the terminal base portion intersecting a specific one of the first wires so that the first press-contacting terminal can be connected to the specific one of the first wires.

(3) The joint connector according to (1), wherein the earth terminal includes, a plurality of earth press-contacting terminals to be connected to the earth wires, respectively, a earth bus bar including a base portion on which the plurality of earth press-contacting terminals are formed, and a round plate terminal connected to the earth bus bar.

(4) The joint connector according to (3), wherein the plurality of earth press-contacting terminals are arranged in a row substantially parallel to the longitudinal direction of the first wires, the second press-contacting terminals are arranged in a row substantially parallel to the longitudinal direction of the first wires and are disposed between a group of first wires and the row of the earth press-contacting terminals, and the earth press-contacting terminals and the second press-contacting terminals overlap each other at end portions thereof when viewed from a direction perpendicular to the longitudinal direction of the first wires.

(5) The joint connector according to (1), wherein the first wire-holding portion is formed at two opposed side walls of a rectangular box-like connector housing with an open top, the second wire-holding portion is formed at one of the remaining side walls, and the plurality of press-contacting joint terminals and the earth terminal are mounted within the connector housing.

(6) The joint connector according to (5), wherein the earth terminal includes, a plurality of earth press-contacting terminals to be connected to the earth wires, respectively, a earth bus bar including a base portion on which the plurality of earth press-contacting terminals are formed, and an extension portion extending from an one longer side of the base portion in a direction perpendicular to a longitudinal direction of the base portion, and a round plate terminal which is formed at a distal end of the extension portion and serves as an earth connection portion, the earth terminal is provided within the connector housing so that the other longer side of the base portion is disposed along and adjacent to the one side wall of the connector housing, and the round plate terminal extends through the other side wall to the exterior of the connector housing, and a joint press-contacting terminal is formed at a portion of the extension portion intersecting a specific one of the first wires so that the joint press-contacting terminal can be connected to the specific one of the first wires.

(7) The joint connector according to (1), wherein the first wires are power-supplying wires and the second wires are signal-purpose or power-receiving wires.

DETAILED DESCRIPTION OF PREFERRED EMBODIMENTS

A preferred embodiment of the present invention will now be described in detail with reference to the accompanying drawings.

Figure 1:
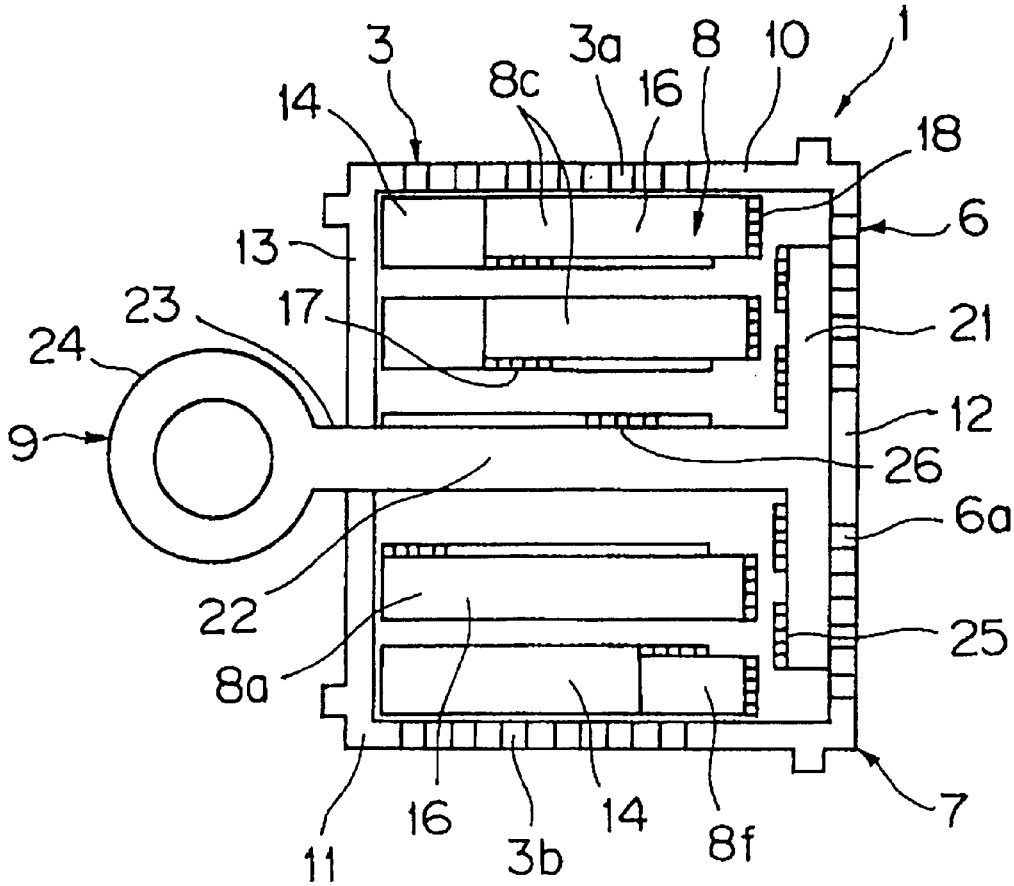
FIG. 1 is a top plan view showing one preferred embodiment of a joint connector of the present invention.
Figure 2:
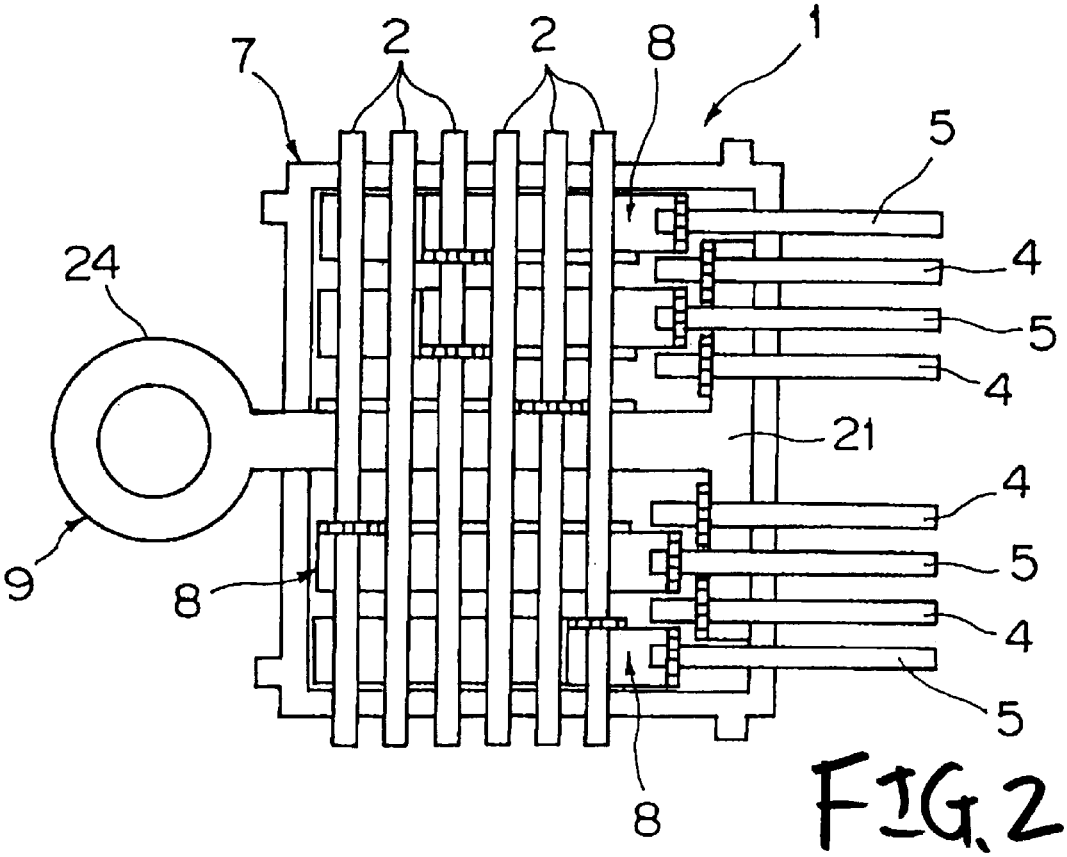
FIG. 2 is a top plan view of the joint connector of the invention on which wires are held.

FIGS. 1 and 2 are views showing one preferred embodiment of a joint connector of the present invention. In FIGS. 1 and 2, the joint connector 1 comprises a connector housing 7, press-contacting joint terminals 8 attached to the connector housing 7, and an earth terminal 9 attached to the connector housing 7. The connector housing 7 includes first wire-holding portions 3 for holding a plurality of power-supplying wires 2 in a parallel, juxtaposed manner, and a second wire-holding portion 6 for holding earth wires 4 and signal-purpose or power-receiving wires 5 for auxiliary equipments in a parallel, juxtaposed manner.

Insulating sheathed wires of a round cross-section, each having a conductor covered with an insulative material, are used as the power-supplying wires 2, the earth wires 4 and the signal-purpose or power-receiving wires 5 for the auxiliary equipments.

Figure 3:
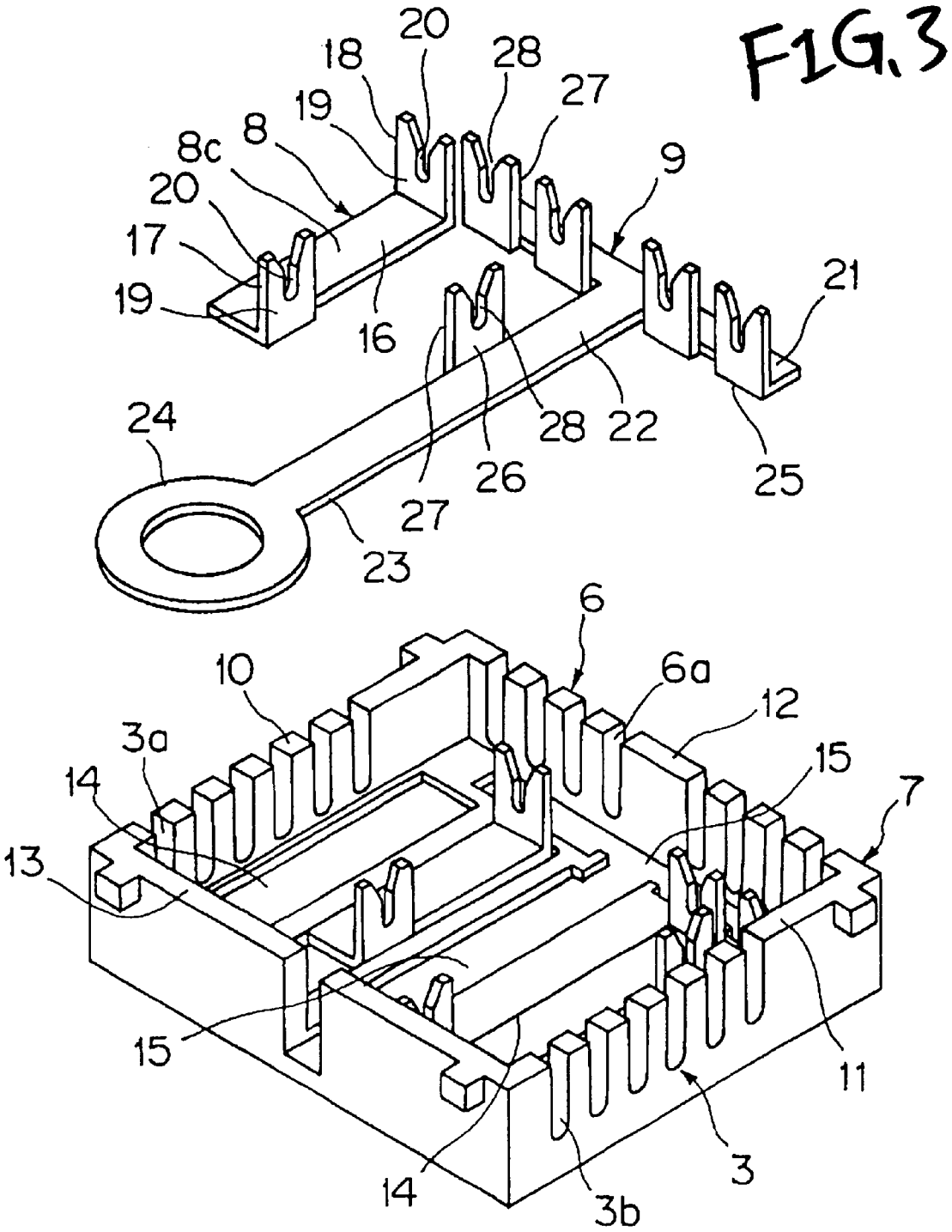
FIG. 3 is a perspective view showing a connector housing, press-contacting joint terminals and an earth terminal.
Figure 4:
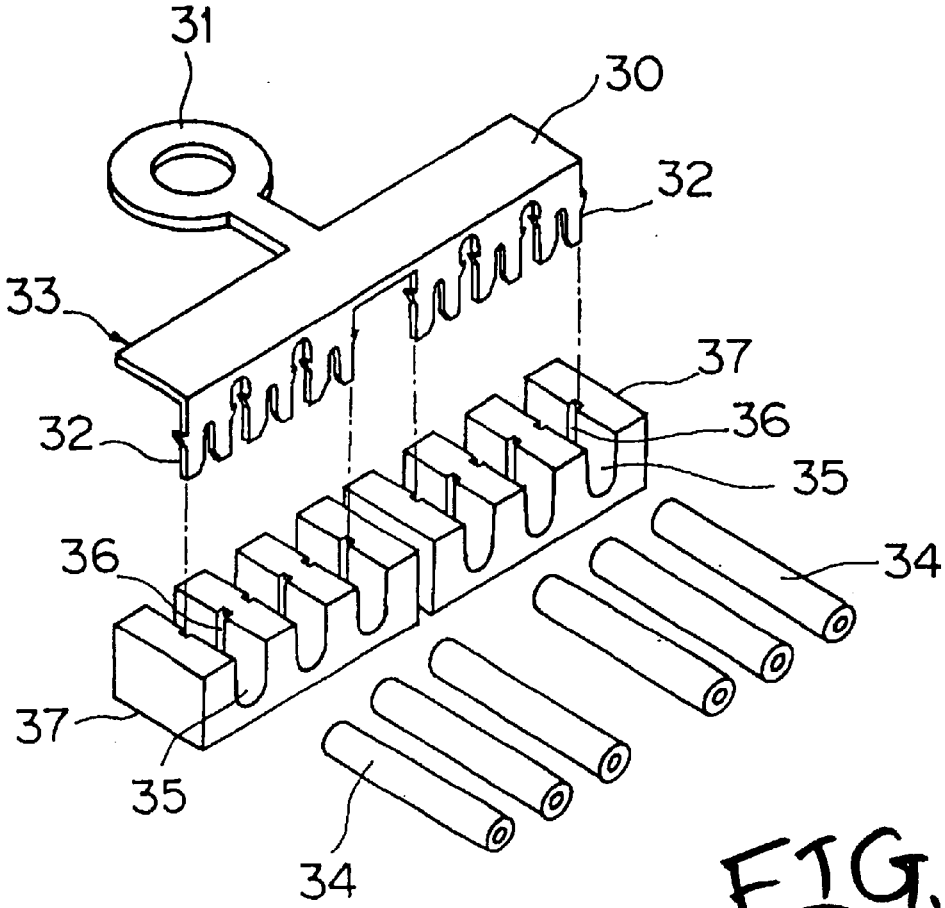
FIG. 4 is a perspective view showing one example of an earth connector.

As shown in FIGS. 1 to 3, the connector housing 7 is formed by injection molding of an insulative material such as a synthetic resin, and this connector housing 7 has, for example, a rectangular box-shape with an open top. A plurality of connector housings 7 can be stacked one upon another, and preferably a lid (not shown) is provided for covering an upper opening.

First wire-holding grooves 3*a* and 3*b*, forming the first wire-holding portions 3, are formed in upper portions of two opposed side walls (first and second side walls defined respectively by the opposed shorter side walls in the illustrated embodiment) 10 and 11 of the connector housing 7. The plurality of (for example, six) first wire-holding grooves 3*a*, 3*b* are formed in the (first/second) side wall 10, 11, and are arranged closer to one (fourth side wall 13) of the remaining side walls at predetermined intervals, the grooves 3*a* being disposed in opposed relation to the groove 3*b*, respectively. Each of the first wire-holding grooves 3*a* and 3*b* has a cross-sectionally U-shape so that the power-supplying wire 2 can be press-fitted and held in the groove. Each of the wires 2 is press-fitted and held in the corresponding wire-holding grooves 3*a* and 3*b*, formed respectively in the first and second side walls 10 and 11, so that the six wires 2 are arranged parallel to one another in the direction of the length of the connector housing 7.

Second wire-holding grooves 6*a*, forming the second wire-holding portion 6, are formed in an upper portion of the other (third side wall 12) of the remaining side walls. In the illustrated embodiment, eight second wire-holding grooves 6*a* are formed in the third side wall 12 except a central portion thereof in such a manner that four grooves 6*a* are formed in each of those portions of the third side wall disposed respectively on opposite sides of the central portion thereof. The second wire-holding grooves 6*a* have a cross-sectionally U-shape so that the wires 4 and 5 for the auxiliary equipments can be press-fitted and held in these grooves 6*a*, respectively. Preferably, the wires 4 and 5 (earth wires 4 and signal-purpose or power-receiving wires 5) for the auxiliary equipments are press-fitted and held respectively in the second wire-holding grooves 6*a* in such a manner that the wires 4 and 5, disposed on each side of the central portion of the third side wall, are alternately arranged from the central portion of the third side wall toward the corresponding one of the opposite ends thereof, and are held in a juxtaposed manner, and one ends of these wires are disposed near to the side of the wire 2 (held in the first wire-holding grooves 3*a* and 3*b*) disposed closest to the third side wall 12.

Joint terminal-mounting portions 14, in which the plurality of (four in the illustrated embodiment) press-contacting joint terminals 8 are detachably mounted, respectively, as well as an earth terminal-mounting portion 15, in which the earth terminal 9 is detachably mounted, are provided within the connector housing 7.

The earth terminal-mounting portion 15 has a generally T-shape, and extends along the third side wall 12 in substantially parallel, contiguous relation thereto, and also extends from a central portion from this portion to the fourth side wall 13 in substantially parallel relation to the first and second side walls 10 and 11.

The plurality of (four in the illustrated embodiment) juxtaposed joint terminal-mounting portions 14 are provided in substantially parallel relation to the first and second side walls 10 and 11. More specifically, two joint terminal-mounting portions 14 are disposed respectively in registry with the 2nd and 4th second wire-holding grooves 6*a* (counting from the central portion of the third side wall 12 toward the corresponding one of the opposite ends thereof) in the direction of the width of these grooves 6*a* (that is, in the direction of the length of the first side wall 10), while the two other joint terminal-mounting portions 14 are disposed respectively in registry with the 2nd and 4th second wire-holding grooves 6*a* (counting from the central portion of the third side wall 12 toward the other of the opposite ends thereof) in the direction of the width of these grooves 6*a*. One ends of these joint terminal-mounting portions are disposed near to the earth terminal-mounting portion 15 while the other ends thereof are disposed near to the fourth side wall 13.

The press-contacting joint terminal 8 includes a rectangular plate-like terminal base portion 16, and first and second press-contacting terminals 17 and 18 formed respectively at opposite ends of the terminal base portion 16. The second press-contacting terminal 18 is formed at one end of the terminal base portion 16, and extends in a direction substantially perpendicular to the direction of the length of the terminal base portion 16, and the width of this second press-contacting terminal 18 is substantially equal to that of the terminal base portion 16. When the press-contacting joint terminals 8 are mounted in the plurality of joint terminal-mounting portions 14, respectively, the second press-contacting terminals 18 are arranged in a row in the direction of the length of the third side wall 12 in substantially parallel relation thereto, and the longitudinal axes or centerlines of the terminal base portions 6 are disposed respectively on the axes (centerlines) of the signal-purpose or power-receiving wires 5, held by the second wire-holding portion 6, when viewed in a direction perpendicular to the plane of the connector housing 7.

The first press-contacting terminal 17 is formed on one of both longer sides of the terminal base portion 16 of the press-contacting joint terminal 8 at the other end thereof, and is disposed in the direction of the length of the terminal base portion 16.

Each of the first and second press-contacting terminals 17 and 18 comprises a generally-rectangular small piece 19 extending perpendicularly relative to the terminal base portion 16, and a wire press-fitting slit 20 is formed in a central portion of this small piece. The width of the slit 20 is so determined that when the wire 2, 5 is press-fitted into this slit 20, the conductor of the wire 2, 5 can be electrically connected to the first/second press-contacting terminal 17, 18.

The length (longitudinal dimension) of the terminal base portion 16 of the press-contacting joint terminal 8 is arbitrarily determined in accordance with the wire 2 to be connected to the first press-contacting terminal 17. More specifically, the press-contacting joint terminals 8 are mounted in such a manner that their one ends are arranged in a common line, that is, in a row, and therefore by changing the length of the terminal base portion 16, the first press-contacting terminal can be connected to the desired wire 2 held in the first wire-holding grooves 3*a* and 3*b*. Six kinds of press-contacting joint terminals 8, having the respective terminal base portions 16 of different lengths, are formed, and the connected condition of the wires can be changed with a simple operation for merely exchanging the press-contacting joint terminals 8.

More specifically, with respect to the press-contacting joint terminals 8, for example, there is formed the first press-contacting joint terminal to be connected to the wire 2 held in the 1st first wire holding grooves 3*a* and 3*b* counting from the fourth side wall 13 (that is, closest to the fourth side wall 13), and similarly there are formed the second, third, fourth, fifth and sixth press-contacting joint terminals which are to be connected respectively to the 2nd to 6th wires 2. The third press-contacting joint terminals 8*c* and 8*c* are mounted respectively in the two joint terminal-mounting portions 14 and 14 disposed near to the first side wall 10, and the first press-contacting joint terminal 8*a* is mounted in the joint terminal-mounting portion 14 disposed the third closest to the first side wall 10, and the sixth press-contacting joint terminal 8*f* is mounted in the remaining joint terminal-mounting portion 14. With this arrangement, the press-contacting joint terminals 8 can be connected to the desired wires 2, respectively. Namely, any one of the six kinds of press-contacting joint terminals 8*a*, 8*c*, 8*f*, . . . can be mounted in each of the joint terminal-mounting portions 14. Incidentally, the terminal base portions 16 of all of the press-contacting joint terminals may have a predetermined length in which case the position of the first press-contacting terminal 17 is changed.

The earth terminal 9 comprises an earth bus bar 23 which includes a rectangular plate-like base portion 21, and an extension portion 22 extending from a central portion of one longer side of this base portion in a direction substantially perpendicular to the direction of the length of this base portion. This earth bus bar 23 has a generally T-shape, and is made of an electrically-conductive material. When the earth terminal 9 is mounted in the earth terminal-mounting portion 15, the base portion 21 extends along the third side wall 12 of the connector housing 7 in substantially parallel, contiguous relation thereto, and the base portion 21 has such a length that opposite ends thereof are disposed near respectively to those second wire-holding grooves 6*a* closest respectively to the first and second side walls 10 and 11. The extension portion 22 has such a length that its distal end is disposed outside the connector housing 7, and this distal end is formed into a ring-like round plate terminal 24 serving as an earth connection portion.

Four earth press-contacting terminals 25 are formed on the one longer side of the base portion 21 in such a manner that two terminals 25 are formed on each of those portions of the base portion 21 disposed respectively on opposite sides of the extension portion 22. When the earth terminal 9 is mounted in the earth terminal-mounting portion 15, these earth press-contacting terminals 25 are arranged in a row along the third side wall 12, and two earth press-contacting terminals 25 are disposed respectively in registry with the 1st and 3rd second wire-holding grooves 6*a* (counting from the central portion of the third side wall 12 toward the corresponding one of the opposite ends thereof) in the direction of the width of these grooves 6*a* (that is, in the direction of the length of the first side wall 10), while the two other earth press-contacting terminals 25 are disposed respectively in registry with the 1st and 3rd second wire-holding grooves 6*a* (counting from the central portion of the third side wall 12 toward the other of the opposite ends thereof) in the direction of the width of these grooves 6*a*.

A joint press-contacting terminal 26 is formed on one longer side of the extension portion 22, and is disposed at a position where the extension portion 22 intersects the associated wire 2 (for example, the wire 2 which is the second closest to the third side wall 12), and this associated wire 2 is connected to the joint press-contacting terminal 26. The position of the joint press-contacting terminal 26 can be changed in the direction of the length of the extension portion 22 so that a desired one of the wires 2 can be selected.

The earth press-contacting terminals 25 and the joint press-contacting terminal 26 have substantially the same configuration as that of the first and second press-contacting terminals 17 and 18. More specifically, each of the terminals 25 and 26 comprises a generally-rectangular small piece 27 extending perpendicularly relative to the earth bus bar 23, and a wire press-fitting slit 28 is formed in a central portion of this small piece. The width of the slit 28 is so determined that when the wire 4, 2 is press-fitted into this slit 28, the conductor of the wire 4, 2 can be electrically connected to the earth press-contacting terminal 25/joint press-contacting terminal 26.

Preferably, the earth press-contacting terminals 25 and the second press-contacting terminals 18 are arranged such that the earth press-contacting terminals 25 and the second press-contacting terminals 18 overlap each other at their end portions when viewed from the longitudinal direction of the first side wall 10.

Next, the operation will be described.

As shown in FIGS. 1 to 3, the earth terminal 9 is mounted in the earth terminal-mounting portion 15 of the connector housing 7, and the third press-contacting joint terminal 8*c*, the third press-contacting joint terminal 8*c*, the first press-contacting joint terminal 8*a* and the sixth press-contacting joint terminal 8*f* are mounted respectively in the 1st to 4th joint terminal-mounting portions 14 counting from the first side wall.

The six power-supplying wires 6 are held in the first wire-holding portions 3 (first wire holding-grooves 3*a* and 3*b*), and the wire 2, disposed closest to the fourth side wall 13, is connected to the first press-contacting terminal 17 of the first press-contacting joint terminal 8*a*, and the third closest wire 2 is connected to the first press-contacting terminals 17 of the two third press-contacting joint terminals 8*c* and 8*c*, and the fifth closest wire 2 is connected to the joint press-contacting terminal 26, and the remotest wire 2 is connected to the first press-contacting terminal 17 of the sixth press-contacting joint terminal 8*f*.

On the other hand, the eight wires 4 and 5 for the auxiliary equipments (that is, the earth wires 4 and for example, the power receiving wires 5) are held respectively in the second wire holding portion 6 (second wire holding grooves 6*a*) in such a manner that the wires 4 and 5, disposed on each side of the central portion of the third side wall, are alternately arranged from the central portion of the third side wall, and are held in a juxtaposed manner, and the one ends of these wires are disposed near to the side of the wire 2 (held in the first wire-holding portions 3) disposed closest to the third side wall 12, and the end portions of the earth wires 4 are connected respectively to the earth press-contacting terminals 25 while the end portions of the power-receiving wires 5 are connected respectively to the second press-contacting terminals 18.

As a result, the 1st and 3rd power-receiving wires 5, counting from the first side wall 10, are connected via the respective third press-contacting joint terminals 8*c* to the 3rd power-supplying wire 2 counting from the fourth side wall 13. The 3rd power-receiving wire 5, counting from the second side wall 11, is connected via the first press-contacting joint terminal 8*a* to the 1st power-supplying wire 2 counting from the fourth side wall 13. The 1st power-receiving wire 5, counting from the second side wall 11, is connected via the sixth press-contacting joint terminal 8*f* to the 6th power-supplying wire 2 counting from the fourth side wall 13, and the wires of power circuits are processed.

The earth wires 4 are connected respectively to the earth press-contacting terminals 25 formed on the base portion 21 of the single earth bus bar 23, and therefore the processing of the wires of the earth circuits are effected. Thus, the plurality of grounding (earthing) processings are effected by connecting the earth wires 4 to the respective earth press-contacting terminals 25 formed on the base portion 21 of the single earth bus bar 23, and therefore the operation for the grounding processing is easier as compared with the case where the grounding processings are effected separately. And besides, the joint press-contacting terminal 26 is provided on the extension portion 22 of the earth bus bar 23, and therefore the intermediate joint grounding can be effected.

Furthermore, the earth wires 4 and the power-receiving wires 5 for the auxiliary equipments are alternately held on the second wire-holding portion 6, and therefore the wires, extending respectively from the power circuit and the earth circuit of one auxiliary equipment, can be arranged in a parallel, juxtaposed manner, and therefore the wires for each auxiliary equipment can be arranged in a collected manner, and the control of the wires is easy.

Therefore, in the joint connector 1 of the present invention, the processing of the wires of the power circuits and the processing of the wires of the earth circuits can both be effected, and the efficiency of the operation is enhanced, and the wires can be easily arranged in a collected manner, and besides the wires for each auxiliary equipment can be arranged in a collected manner, and the control of the wires is easy.

The terminal base portion 16 of each press-contacting joint terminal 8 is disposed on the axis of the corresponding wire 5 held by the second wire-holding portion 6, and the power-supplying wires 2 are arranged in the direction substantially perpendicular to the axis of the terminal base portion. Therefore, the length (longitudinal dimension) of the terminal base portion 16 can be changed without interference by the other terminal base portions 16, and besides the position of the first press-contacting terminal 17 can be changed. Therefore, merely by changing the length of the terminal base portion 16 and the position of the first press-contacting terminal 17 in the direction of the length of the terminal base portion 16, the arbitrary power-supplying wire can be selected, and the connected condition of the wires can be easily changed.

More specifically, for example, any one of the six kinds of press-contacting joint terminals 8 can be mounted in each of the joint terminal-mounting portions 14, and by doing so, the connected condition can be easily changed with the simple operation for merely exchanging the press-contacting joint terminals 8.

The earth press-contacting terminals 25, as well as the second press-contacting terminals 18, are arranged in a row, and the terminals 25 and 18 are arranged such that the terminals 25 and 18 overlap each other at their end portions when viewed from the longitudinal direction of the first side wall 10. With this arrangement, the length of the third and fourth side walls 12 and 13 can be made shorter as compared with the case where the earth press-contacting terminals 25 and the second press-contacting terminals 18 are arranged in a row, and therefore the joint connector 1 can be formed into a compact design.

The plurality of press-contacting joint terminals 8 and the earth terminal 9 are mounted on the common connector housing 7, and besides the first and second wire-holding portions 3 and 6 are provided at this connector housing, and therefore the wires 2, 4 and 5 need only to be mounted on the single connector housing 7, and the efficiency of the wire-mounting operation is high.

Furthermore, the power-supplying wires 2 are provided on the first and second side walls 10 and 11, and the wires 4 and 5 for the auxiliary equipments are provided on the third side wall 12, and the earth connection portion 24 is provided at the fourth side wall 13, and thus other wires or the like than the predetermined wires or the earth connection portion are not provided on each of these side walls, and therefore the power-supplying wires 2, the wires 4 and 5 for the auxiliary equipments and the earth connection portion 24 can be easily controlled.

As described above, in the invention, the processing of the wires of the power circuits and the processing of the wires of the earth circuits can both be effected, and the efficiency of the operation is enhanced, and the wires can be easily arranged in a collected manner, and therefore the wires for each auxiliary equipment can be arranged in a collected manner, and the control of the wires is easy.

In the invention, merely by changing the length of the terminal base portion and the position of the first press-contacting terminal in the direction of the length of the terminal base portion, the arbitrary power-supplying wire can be selected, and the connected condition of the wires can be easily changed.

In the invention, the plurality of earth press-contacting terminals are formed on the single earth bus bar base portion, and therefore the operation for the grounding processing is easier as compared with the case where the grounding processings are effected separately.

In the invention, the earth press-contacting terminals, as well as the second press-contacting terminals, are arranged in one row in such a manner that the earth press-contacting terminals and the second press-contacting terminals overlap each other at their end portions, and with this arrangement the joint connector can be formed into a small design.

In the invention, the wires need only to be mounted on the single connector housing, and the efficiency of the wire-mounting operation is high.

In the invention, the power-supplying wires, the wires for the auxiliary equipments and the earth connection portion can be easily controlled, and the intermediate joint grounding can be effected.

What is claimed is:

1. A joint connector comprising:

a first wire-holding portion for holding first wires in a juxtaposed manner;

a second wire-holding portion for alternately holding earth wires and second wires for an auxiliary equipment in a juxtaposed manner in a direction substantially perpendicular to a longitudinal direction of the first wires;

a plurality of press-contacting joint terminals, each including, a first press-contacting terminal to be electrically connected to the first wires, and a second press-contacting terminal to be electrically connected to the second wires, which connected to the first press-contacting terminal; and an earth terminal for earthing to be electrically connected to the earth wires.

2. The joint connector according to claim 1, wherein the earth wires and the second wires are held by the second wire-holding portion so that one ends of the earth wires and the second wires are disposed to a side of the first wires, each of the plurality of press-contacting joint terminals includes a terminal base portion extending in a longitudinal direction of the second terminals, the second press-contacting terminal is formed at one end of the terminal base portion, the first press-contacting terminal is formed at a portion of the terminal base portion intersecting a specific one of the first wires so that the first press-contacting terminal can be connected to the specific one of the first wires.

3. The joint connector according to claim 1, wherein the earth terminal includes, a plurality of earth press-contacting terminals to be connected to the earth wires, respectively, a earth bus bar including a base portion on which the plurality of earth press-contacting terminals are formed, and a round plate terminal connected to the earth bus bar.

4. The joint connector according to claim 3, wherein the plurality of earth press-contacting terminals are arranged in a row substantially parallel to the longitudinal direction of the first wires, the second press-contacting terminals are arranged in a row substantially parallel to the longitudinal direction of the first wires and are disposed between a group of first wires and the row of the earth press-contacting terminals, and the earth press-contacting terminals and the second press-contacting terminals overlap each other at end portions thereof when viewed from a direction perpendicular to the longitudinal direction of the first wires.

5. The joint connector according to claim 1, wherein the first wire-holding portion is formed at two opposed side walls of a rectangular box-like connector housing with an open top, the second wire-holding portion is formed at one of the remaining side walls, and the plurality of press-contacting joint terminals and the earth terminal are mounted within the connector housing.

6. The joint connector according to claim 5, wherein the earth terminal includes, a plurality of earth press-contacting terminals to be connected to the earth wires, respectively, a earth bus bar including a base portion on which the plurality of earth press-contacting terminals are formed, and an extension portion extending from an one longer side of the base portion in a direction perpendicular to a longitudinal direction of the base portion, and a round plate terminal which is formed at a distal end of the extension portion and serves as an earth connection portion, the earth terminal is provided within the connector housing so that the other longer side of the base portion is disposed along and adjacent to the one side wall of the connector housing, and the round plate terminal extends through the other side wall to the exterior of the connector housing, and a joint press-contacting terminal is formed at a portion of the extension portion intersecting a specific one of the first wires so that the joint press-contacting terminal can be connected to the specific one of the first wires.

7. The joint connector according to claim 1, wherein the first wires are power-supplying wires and the second wires are signal-purpose or power-receiving wires.

* * * * *